US009754739B2

(12) United States Patent
Honda et al.

(10) Patent No.: US 9,754,739 B2
(45) Date of Patent: Sep. 5, 2017

(54) SWITCH STRUCTURE AND EXPLOSION-PROOF DEVICE

(71) Applicant: Azbil Corporation, Chiyoda-ku (JP)

(72) Inventors: Yoshiro Honda, Chiyoda-ku (JP); Takashi Watanabe, Chiyoda-ku (JP)

(73) Assignee: AZBIL CORPORATION, Chiyoda-ku (JP)

( * ) Notice: Subject to any disclaimer, the term of this patent is extended or adjusted under 35 U.S.C. 154(b) by 0 days.

(21) Appl. No.: 15/139,131

(22) Filed: Apr. 26, 2016

(65) Prior Publication Data

US 2016/0240331 A1 Aug. 18, 2016

Related U.S. Application Data

(63) Continuation of application No. PCT/JP2014/078708, filed on Oct. 29, 2014.

(30) Foreign Application Priority Data

Oct. 29, 2013 (JP) ..... 2013-223919

(51) Int. Cl.
*H01H 9/04* (2006.01)
*H01H 36/00* (2006.01)
*H01H 36/02* (2006.01)

(52) U.S. Cl.
CPC ..... *H01H 9/042* (2013.01); *H01H 36/00* (2013.01); *H01H 36/02* (2013.01); *H01H 36/004* (2013.01);
(Continued)

(58) Field of Classification Search
CPC .. H01H 36/00; H01H 9/042; H01H 2223/002; H01H 2235/01; H01H 36/0006; H01H 36/004; H01H 36/02
See application file for complete search history.

(56) References Cited

U.S. PATENT DOCUMENTS 4,152,755 A * 5/1979 Trosper ..... F21L 4/005 362/158
5,369,386 A * 11/1994 Alden ..... H01H 36/0066 335/206

(Continued)

FOREIGN PATENT DOCUMENTS

| | | |
|---|---|---|
| CN | 1497633 A | 5/2004 |
| JP | H3-500939 | 2/1991 |
| WO | 89/04014 | 5/1989 |

OTHER PUBLICATIONS

Combined Chinese Office Action and Search Report issued Mar. 15, 2017 in Chinese Patent Application No. 201480059514.2 (with English translation of categories of cited documents).

*Primary Examiner* — Bernard Rojas

(74) *Attorney, Agent, or Firm* — Oblon, McClelland, Maier & Neustadt, L.L.P.

(57) ABSTRACT

A switch that includes a hermetically sealed container including a container wall separating an inside of the hermetically sealed container from an outside of the hermetically sealed container, a magnetic sensor arranged in the hermetically sealed container and configured to be turned ON/OFF by a magnetic field of a magnet acting from the outside of the hermetically sealed container through the container wall of the hermetically sealed container, and a first magnetic body provided at the container wall of the hermetically sealed container and serving as a path of the magnetic field acting on the magnetic sensor from the magnet.

23 Claims, 5 Drawing Sheets

(52) U.S. Cl.
CPC ... *H01H 36/0006* (2013.01); *H01H 2223/002* (2013.01); *H01H 2235/01* (2013.01)

(56) References Cited

U.S. PATENT DOCUMENTS

| | | | | |
|---|---|---|---|---|
| 7,256,671 | B1 * | 8/2007 | Preaux | F21L 14/023 335/205 |
| 2004/0129442 | A1 * | 7/2004 | Mayr | H03K 17/97 174/520 |

* cited by examiner

Prior Art

SWITCH STRUCTURE AND EXPLOSION-PROOF DEVICE

CROSS-REFERENCE TO RELATED APPLICATIONS

This application is a continuation of International Application No. PCT/JP2014/078708, filed Oct. 29, 2014, which claims priority to Japanese Patent Application No. 2013-223919, filed Oct. 29, 2013. The entire contents of the above-identified applications are incorporated herein by reference.

FIELD

The present disclosure relates to a switch structure that turns ON/OFF a magnetic sensor arranged in a hermetically sealed container from the outside of the hermetically sealed container, and also relates to an explosion-proof device including the switch structure.

BACKGROUND

Conventionally, in an explosion-proof device such as a pressure transmitter, a hermetically sealed container serves as an explosion-proof container, a magnetic sensor is arranged in the explosion-proof container, and a switch structure that turns ON/OFF the magnetic sensor from the outside of the explosion-proof container is used (for example, Japanese Unexamined Patent Application Publication (Translation of PCT Application) No. 3-500939 (Japanese Patent No. 2668571).

FIG. 6 shows a primary portion of a conventional switch structure used in an explosion-proof device. In the drawing, reference sign 10 denotes an explosion-proof container, 20 denotes a magnetic sensor arranged in the explosion-proof container 10, and 30 denotes a magnet generating a magnetic field. A container wall 10*a* that separates the inside of the explosion-proof container 10 from the outside is a non-magnetic body. Also, the magnet 30 is provided outside the explosion-proof container 10 movably back and forth with respect to the magnetic sensor 20. Although not shown, the explosion-proof container 10 houses an electric circuit and an electric part to be protected.

With this switch structure, if the magnet 30 located outside the container wall 10*a* of the explosion-proof container 10 is moved close to the magnetic sensor 20, the magnetic field of the magnet 30 acts on the magnetic sensor 20 through the container wall 10*a*, and the magnetic sensor 20 is turned ON. That is, the magnetic sensor 20 senses the magnetism from the magnet 30 acting through the container wall 10*a*, and outputs a magnetism sensing signal. If the magnet 30 is moved far from the magnetic sensor 20, the magnetic sensor 20 no longer senses the magnetism from the magnet 30, and the magnetic sensor 20 is turned OFF.

The switch structure using the magnetic sensor 20 and the magnet 30 allows the operation of the electric circuit housed in the explosion-proof container 10 to be switched and the various settings of the electric circuit to be made from the outside while keeping the explosion-proof performance of the inside of the explosion-proof container 10. As shown in FIG. 7, this switch structure typically has a configuration in which the magnetic sensor 20 and the magnet 30 make a pair, the pair serves as a single magnetic switch 40, and a plurality of the magnetic switches 40 are arranged in parallel.

In an example shown in FIG. 7, magnetic sensors 20-1 to 20-4 are provided in parallel in the explosion-proof container 10, magnets 30-1 to 30-4 are provided outside the explosion-proof container 10 movably back and forth with respect to the magnetic sensors 20-1 to 20-4, and the magnetic sensors 20-1 to 20-4 and the magnets 30-1 to 30-4 configure magnetic switches 40-1 to 40-4. The container wall 10*a* being the non-magnetic body is located between the magnetic sensors 20-1 to 20-4 and the magnets 30-1 to 30-4.

In the switch structure with the plurality of magnetic switches 40 arranged in parallel, a distance L between adjacent two of the magnetic switches 40 is determined as a distance to prevent one magnet 30 from being influenced by the magnetic field of another magnet 30 so that each of the magnetic switches 40 can be independently turned ON/OFF. That is, since the container wall 10*a* is the non-magnetic body, the magnetic field of each magnet 30 is spread in a wide range. Hence, the distance L between adjacent two of the magnetic switches 40 is sufficiently determined to prevent the magnetic field of the magnet 30 from acting on the other magnetic sensors 20.

SUMMARY

A switch that includes a hermetically sealed container including a container wall separating an inside of the hermetically sealed container from an outside of the hermetically sealed container, a magnetic sensor arranged in the hermetically sealed container and configured to be turned ON/OFF by a magnetic field of a magnet acting from the outside of the hermetically sealed container through the container wall of the hermetically sealed container, and a first magnetic body provided at the container wall of the hermetically sealed container and serving as a path of the magnetic field acting on the magnetic sensor from the magnet.

DESCRIPTION OF EMBODIMENTS

Figure 1:
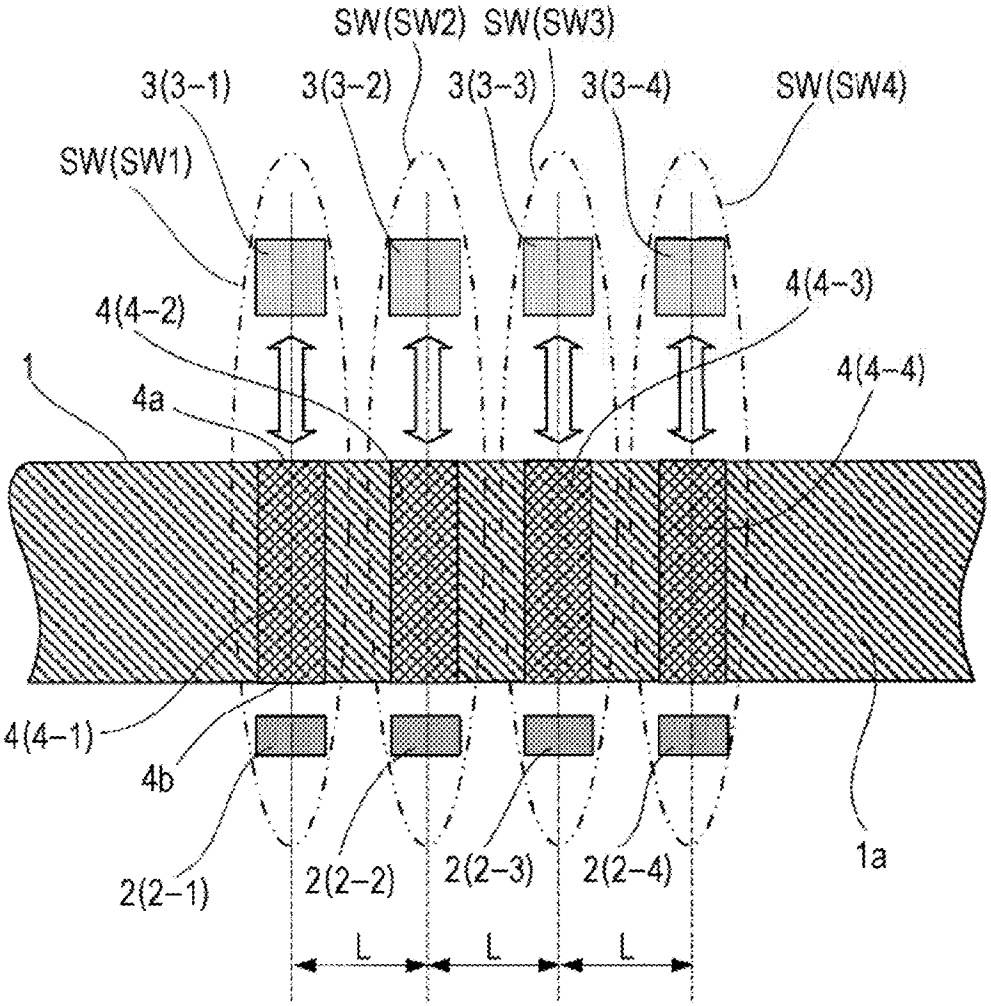
FIG. 1 is an illustration showing a primary portion of an embodiment (first embodiment) of a switch structure according to the disclosure.

However, with the above-described conventional switch structure, if the container wall 10*a* is thick, the distance between the magnet 30 and the magnetic sensor 20 is large. Owing to this, the magnet 30 has had to use a magnet with a strong magnetic force (large magnet) so that the magnetic field of the magnet 30 correctly acts on the magnetic sensor 20 through the container wall 10*a*.

Also, with the above-described conventional switch structure, if the switch structure includes the plurality of magnetic switches 40 arranged in parallel, and if the container wall 10*a* is thick, the magnets 30 have had to use large magnets, and in addition, since the magnetic fields of the magnets 30 are spread in wide ranges, the distance L between adjacent two of the magnetic switches 40 has had to be increased.

Also, with the above-described conventional switch structure, to decrease the distance L between adjacent two of the magnetic switches 40, the container wall 10*a* has had to be thinned so that the magnetic fields of even magnets having weak magnetic forces (small magnets) correctly act on the magnetic sensors 20. That is, since there are many limitations in view of the layout of respective components, it has been difficult to attain requests on increasing the thickness of the container wall 10*a* and decreasing the distance L between adjacent two of the magnetic switches 40.

The disclosure is made to solve such problems, and an object of the disclosure is to provide a switch structure that does not have to use a large magnet even if a container wall (non-magnetic body) of a hermetically sealed container is thick.

Also, another object of the disclosure is to provide a switch structure that can decrease the distance between adjacent magnetic switches and individually independently turn ON/OFF magnetic switches even if a container wall (non-magnetic body) of a hermetically sealed container is thick.

To attain the objects, the disclosure includes a hermetically sealed container including a container wall formed of a non-magnetic body and separating the inside from the outside; a magnet generating a magnetic field; a magnetic sensor arranged in the hermetically sealed container and configured to be turned ON/OFF by the magnetic field of the magnet acting from the outside of the hermetically sealed container through the container wall of the hermetically sealed container; and a first magnetic body provided at the container wall of the hermetically sealed container and serving as a path of the magnetic field acting on the magnetic sensor from the magnet.

In the switch structure of the disclosure, the magnetic field from the magnet acts on the magnetic sensor through the first magnetic body provided at the container wall (non-magnetic body) of the hermetically sealed container. For example, in a configuration in which the magnet is provided movably back and forth with respect to an end surface of the first magnetic body, the end surface located near the outside of the hermetically sealed container, if the magnet is moved close to the end surface of the first magnetic body located near the outside of the hermetically sealed container, the magnetic field from the magnet acts on the magnetic sensor through the first magnetic body provided at the container wall (non-magnetic body) of the hermetically sealed container. Hence, even if the container wall (non-magnetic body) of the hermetically sealed container is thick, the magnetic field from the magnet efficiently acts on the magnetic sensor, and the magnet no longer needs to use a large magnet. Also, in the switch structure of the disclosure, since the magnetic field from the magnet acts on the magnetic sensor through the first magnetic body provided at the container wall (non-magnetic body) of the hermetically sealed container, the range of the magnetic field of the magnet is decreased in size.

Advantageous Effects of Disclosure

With the disclosure, since the first magnetic body serving as the path of the magnetic field acting on the magnetic sensor from the magnet is provided at the container wall (non-magnetic body) of the hermetically sealed container, even if the container wall (non-magnetic body) of the hermetically sealed container is thick, the magnetic field from the magnet can efficiently act on the magnetic sensor. The magnet no longer needs to use a large magnet.

Also, with the disclosure, since the magnetic field from the magnet acts on the magnetic sensor through the first magnetic body provided at the container wall (non-magnetic body) of the sealed container, even if the container wall (non-magnetic body) of the hermetically sealed container is thick, the distance between adjacent two of the magnetic switches is decreased, and each magnetic switch can be independently turned ON/OFF.

An embodiment of the disclosure is described in detail below.

First Embodiment: Switch Structure

FIG. 1 is an illustration showing a primary portion of an embodiment (first embodiment) of a switch structure according to the disclosure. In the drawing, reference sign 1 denotes an explosion-proof container, 2 denotes a magnetic sensor arranged in the explosion-proof container 1, and 3 denotes a magnet generating a magnetic field. A container wall 1*a* that separates the inside of the explosion-proof container 1 from the outside is a non-magnetic body. Also, the magnet 3 is provided outside the explosion-proof container 1 movably back and forth with respect to the magnetic sensor 2. Although not shown, the explosion-proof container 1 houses an electric circuit and an electric part to be protected.

In this switch structure, magnetic bodies 4-1 to 4-4 are provided, in correspondence with magnetic sensors 2-1 to 2-4, at the container wall (non-magnetic body) 1*a* arranged between the magnetic sensors 2-1 to 2-4 and magnets 3-1 to 3-4. This magnetic body 4 (4-1 to 4-4) has a columnar shape. A first end surface 4*a* of the magnetic body 4 is exposed to the outside of the explosion-proof container 1, and a second end surface 4*b* thereof is exposed to the inside of the explosion-proof container 1.

The magnetic sensors 2-1 to 2-4 are provided in the explosion-proof container 1 to face the second end surfaces 4*b* of the magnetic bodies 4-1 to 4-4. The magnets 3-1 to 3-4 are provided outside the explosion-proof container 1 movably back and forth with respect to the first end surfaces 4*a* of the magnetic bodies 4-1 to 4-4. These magnetic sensors 2-1 to 2-4, magnets 3-1 to 3-4, and magnetic bodies 4-1 to 4-4 configure magnetic switches SW1 to SW4.

In this switch structure (the switch structure with the plurality of magnetic switches SW arranged in parallel), the magnetic field from the magnet 3 outside the explosion-proof container 1 acts on the magnetic sensor 2 through the magnetic body 4 provided at the container wall 1*a* of the explosion-proof container 1. For example, if the magnet 3-1 is moved close to the end surface 4*a* of the magnetic body 4-1 exposed to the outside of the explosion-proof container 1, the magnetic field from this magnet 3-1 acts on the magnetic sensor 2-1 in the explosion-proof container 1 through the magnetic body 4-1 provided at the container wall 1*a* of the explosion-proof container 1.

As described above, in this switch structure, since the magnetic field from the magnet 3 acts on the magnetic sensor 2 through the magnetic body 4 provided at the container wall 1*a* of the explosion-proof container 1, even if the container wall 1*a* of the explosion-proof container 1 is thick, the magnetic field from the magnet 3 efficiently acts on the magnetic sensor 2, and the magnet 3 does not have to use a large magnet.

Also, with this switch structure, since the magnetic field from the magnet 3 acts on the magnetic sensor 2 through the magnetic body 4 provided at the container wall 1*a* of the explosion-proof container 1, the range of the magnetic field of the magnet 3 is decreased in size. That is, with this switch structure, the magnetic field from the magnet 3 acts on the magnetic sensor 2 through the magnetic body 4 provided at the container wall 1*a* of the explosion-proof container 1 on a magnetic switch SW basis, and hence the range of the magnetic field of the magnet 3 of each magnetic switch SW is decreased in size. Accordingly, even if the container wall 1*a* of the explosion-proof container 1 is thick, a distance L between adjacent two of the magnetic switches SW is decreased, and each magnetic switch SW can be independently turned ON/OFF.

In this embodiment, the end surfaces 4*a* and 4*b* of the magnetic body 4 provided at the container wall 1*a* of the explosion-proof container 1 are exposed from the container wall 1*a*. However, the end surface 4*a* or 4*b* of the magnetic body 4 may not be exposed from the container wall 1*a*. For example, if the end surface 4*a* of the magnetic body 4 is embedded in the middle of the container wall 1*a* without being exposed from the container wall 1*a*, the magnetic body 4 is prevented from rusting because of the moisture etc. from the outside. Also, in this embodiment, the magnet 3 is provided movably back and forth with respect to the end surface 4*a* of the magnetic body 4 located outside the explosion-proof container 1. However, for example, the magnet 3 may be separated from the explosion-proof container 1, held by a person with his/her hand, and moved close to the end surface 4*a* of the magnetic body 4 located outside the explosion-proof container 1.

Also, in this embodiment, the container 1 serves as the explosion-proof container. However, the container 1 may not be the explosion-proof container as long as the container 1 is a hermetically sealed container. Also, in this embodiment, the switch structure with the plurality of magnetic switches SW arranged in parallel is exemplarily described. However, the number of magnetic switches SW may be one.

Second Embodiment: Explosion-Proof Device

Figure 2:
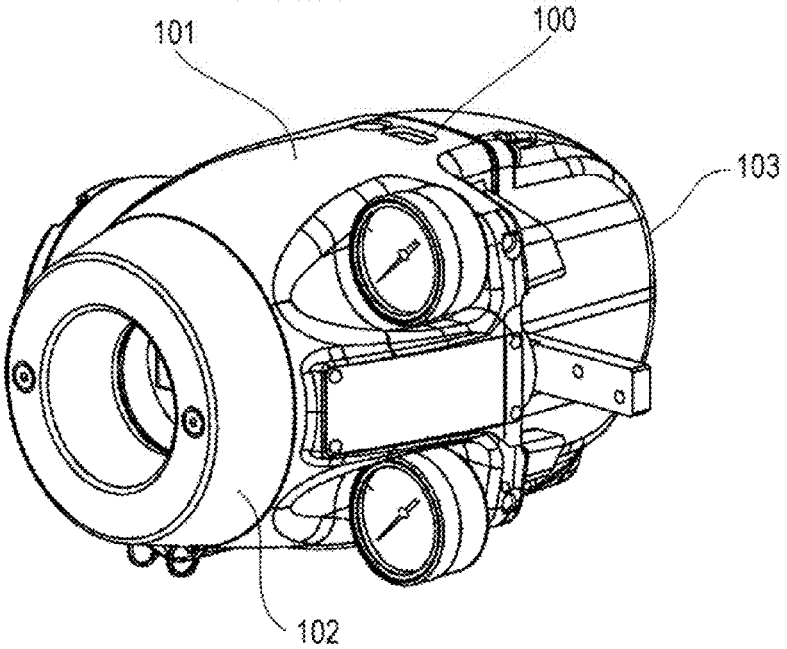
FIG. 2 is an external perspective view of an explosion-proof device (external perspective view of a positioner) including the switch structure according to the disclosure.

FIG. 2 is an external perspective view of an explosion-proof device (second embodiment) including the switch structure according to the disclosure. FIG. 2 shows a positioner that controls the opening degree of a pneumatically operated control valve (valve), as an explosion-proof device. A positioner is obliged to have sufficient explosion-proof performance by an explosion-proof standard so as to be used in explosive gas atmospheres.

Figure 4:
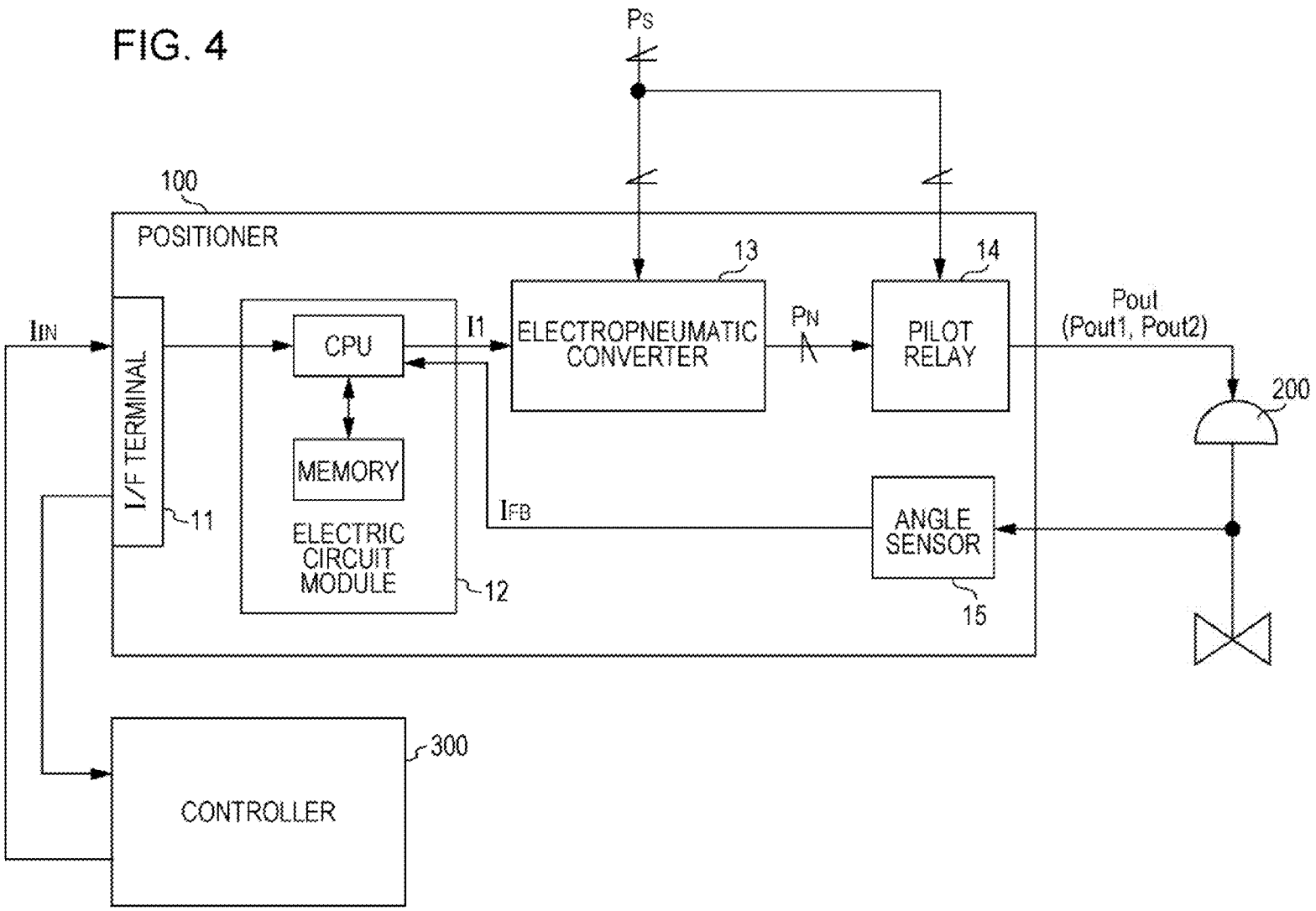
FIG. 4 is a block diagram showing an inner configuration of this positioner.

FIG. 4 shows a block diagram of an inner configuration of this positioner 100. In the drawing, reference sign 11 denotes an I/F (interface) terminal, 12 denotes an electric circuit module including a CPU (Central Processing Unit), a memory, etc., 13 denotes an electropneumatic converter, 14 denotes a pilot relay that amplifies a nozzle back pressure $P_N$ from the electropneumatic converter 13 and supplies the amplified pressure as an output pneumatic pressure Pout to a valve 200, and 15 denotes an angle sensor that detects an operation position of the valve 200 and feeds back the detected position to the CPU of the electric circuit module 12. These components configure the positioner 100.

In this positioner 100, if the CPU of the electric circuit module 12 receives an input electric signal $I_{IN}$ given from a controller 300, the CPU gives a current I1 corresponding to the input electric signal $I_{IN}$ to the electropneumatic converter 13. This current I1 is converted into the nozzle back pressure $P_N$ in the electropneumatic converter 13, and transmitted to the pilot relay 14. The pilot relay 14 amplifies the nozzle back pressure $P_N$, and supplies the amplified pressure as the output pneumatic pressure Pout to the valve 200. Accordingly, the opening degree of the valve 200, that is, the process flow rate is controlled. Also, the opening degree of the valve 200 is detected by the angle sensor 15, and is returned as a feedback signal $I_{FB}$ to the CPU of the electric circuit module 12.

In FIG. 4, reference sign Ps denotes a supply pneumatic pressure to the electropneumatic converter 13 and the pilot relay 14. Also, there are two types of a pilot relay: the one with a single-acting type that outputs a single output pneumatic pressure to a single nozzle back pressure $P_N$, and the one with a double-acting type that outputs two output pneumatic pressures to a single nozzle back pressure $P_N$. In this embodiment, the pilot relay is the double-acting type, and outputs two output pneumatic pressures Pout1 and Pout2. To operate the valve 200 forward, the output pneumatic pressure Pout1 is set to be higher than the output pneumatic pressure Pout2. To operate the valve 200 backward, the output pneumatic pressure Pout2 is set to be higher than the output pneumatic pressure Pout1.

In this positioner 100, the I/F (interface) terminal 11, the electric circuit module 12, the electropneumatic converter 13, and the angle sensor 15 are housed in the inner space of a case 101 (FIG. 2). That is, the case 101 serves as an explosion-proof container (hereinafter, referred to as explosion-proof container). The I/F (interface) terminal 11, the electric circuit module 12, the electropneumatic converter 13, and the angle sensor 15 are housed in the explosion container 101.

Figure 3:
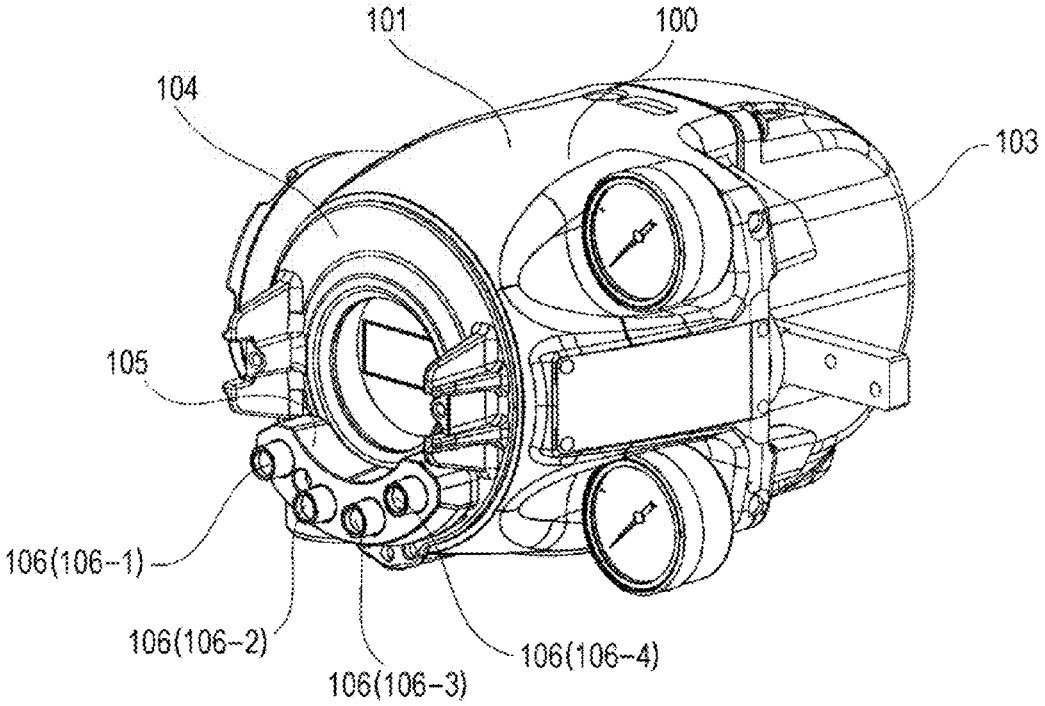
FIG. 3 is an illustration showing a state in which a cover provided on a front surface of this positioner is removed.

A cover 102 is mounted on a front surface of the explosion-proof container 101. If the cover 102 is removed, as shown in FIG. 3, a main cover (non-magnetic body) 104 forming part of a container wall of the explosion-proof container 101 appears. A switch holder 105 is fixed to the main cover 104 by a screw. Four push buttons 106 (106-1 to 106-4) are mounted at this switch holder 105. Also, a cover 103 is mounted on a back surface of the explosion-proof container 101. The pilot relay 14 is provided in the space covered with the cover 103.

Figure 5:
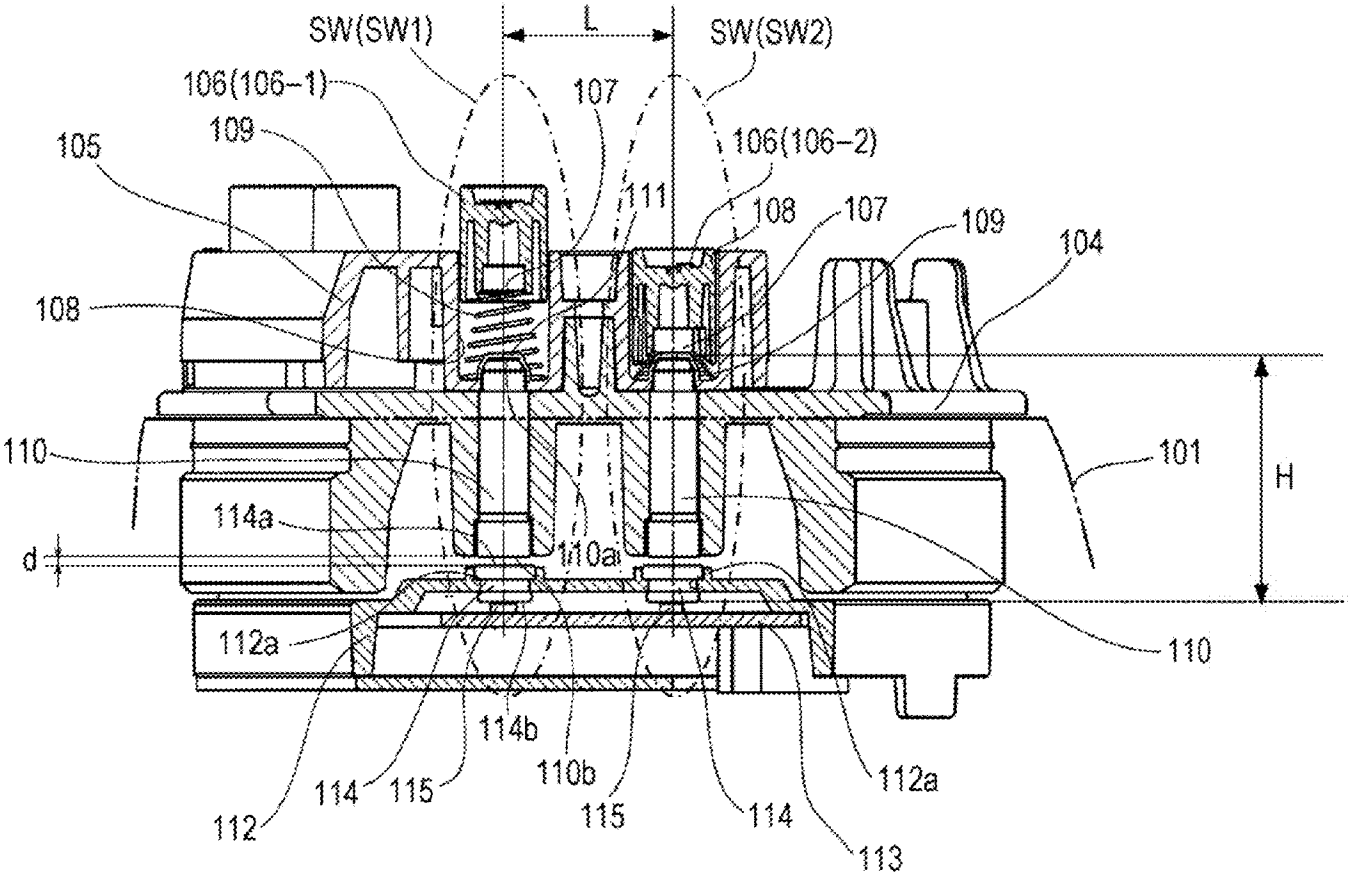
FIG. 5 is a fracture cross-section showing a mounting structure of a switch holder and a push button to a main cover (container wall) of this positioner.
Figure 6:
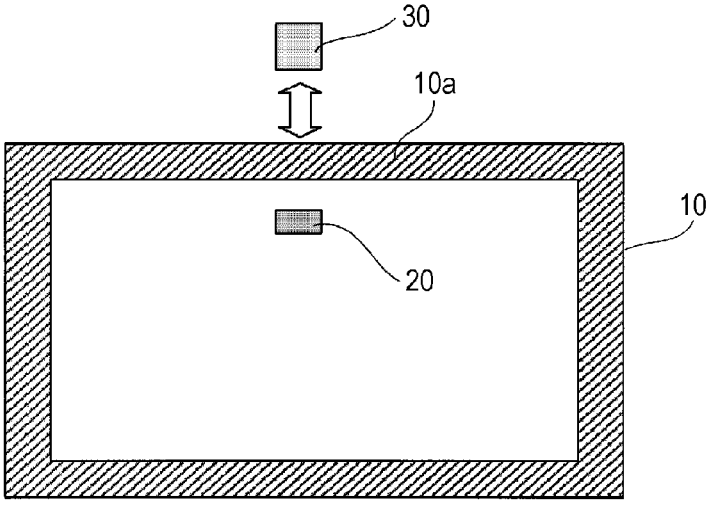
FIG. 6 is an illustration showing a primary portion of a conventional switch structure used in an explosion-proof container.
Figure 7:
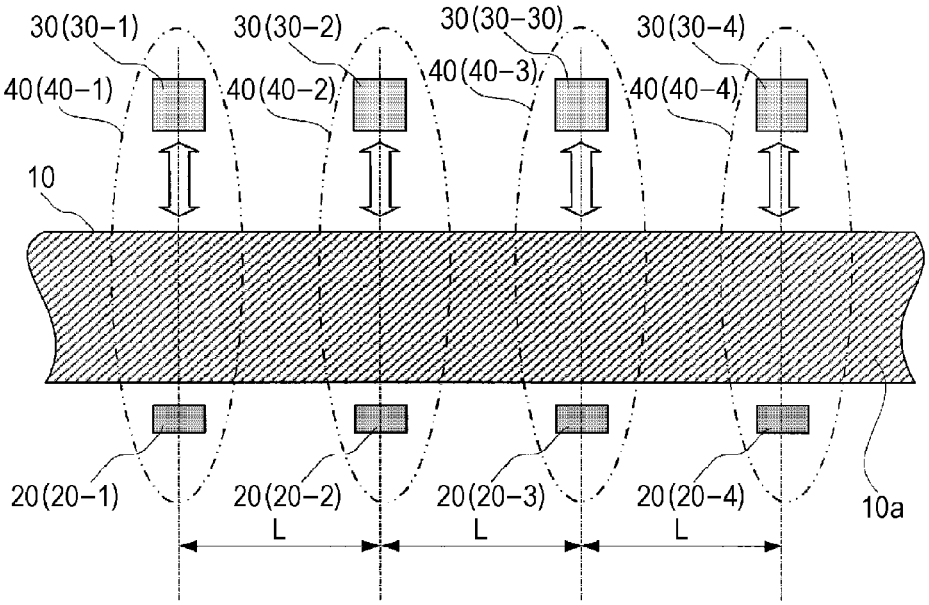
Prior Art FIG. 7
FIG. 7 is an illustration showing a primary portion of a conventional switch structure including a plurality of magnetic switches arranged in parallel.

FIG. 5 shows a mounting structure of the switch holder 105 and the push buttons 106 to the main cover 104. FIG. 5 only shows mounting portions of the push buttons 106-1 and 106-2; however the push buttons 106-3 and 106-4 are similarly mounted. The switch holder 105 and the push buttons 106 are formed of resin members. The push buttons 106 each have a columnar shape. The mounting structure is described below particularly for a single push button 106.

The push button 106 has a columnar magnet 107 provided at a bottom portion thereof. The push button 106 is inserted into a mounting hole 108 provided at the switch holder 105 in a state in which the magnet 107 is arranged at the lower side. A compression coil spring 109 is provided in the mounting hole 108, between the bottom portion of the push button 106 and a bottom portion of the mounting hole 108. A first end of the compression coil spring 109 is fixed to the bottom portion of the mounting hole 108 of the switch holder 105, and a second end of the compression coil spring 109 is fixed to the bottom portion of the push button 106.

A guide pin (first magnetic body) 110 is provided at the main cover (container wall) 104, at a position at which the guide pin 110 faces the mounting hole 108 of the switch holder 105. A first end surface 110*a* of the guide pin 110 penetrates through an upper surface (a surface facing the outside of the explosion-proof container 101) of the main cover 104, and is located at a position in a recess portion 111 formed at a bottom surface of the mounting hole 108 of the switch holder 105. A second end surface 110*b* of the guide pin 110 is located at a lower surface (a surface facing the inside of the explosion-proof container 101) of the main cover 104, and is exposed to the inside of the explosion-proof container 101. In this example, since the end surface 110*a* of the guide pin 110 is located in the recess portion 111 formed at the bottom surface of the mounting hole 108 of the switch holder 105, the end surface 110*a* of the guide pin 110 is not exposed to the outside of the explosion-proof container 101, and hence the guide pin 110 is prevented from rusting because of the moisture etc. from the outside.

An electrical holder (substrate holding member) 112 formed of a resin member is provided in the explosion-proof container 101. A main board 113 being a resin substrate is mounted at the electrical holder 112. Also, a sub-guide pin (second magnetic body) 114 is provided at the electrical holder 112 at a position at which the sub-guide pin 114 faces the end surface 110*b* of the guide pin 110 with a gap d interposed therebetween. A Hall IC (magnetic sensor) 115 is provided on the main board 113, at a position at which the Hall IC 115 faces the sub-guide pin 114. The sub-guide pin 114 is provided at a through hole 112*a* formed in the electrical holder 112, in a state in which a first end surface 114*a* and a second end surface 114*b* of the sub-guide pin 114 are exposed.

That is, the electrical holder 112 holds the main board 113 in the explosion-proof container 101 to cause a surface of the main board 113 provided with the Hall IC 115 to face the main cover 104, and to cover the space above the Hall IC 115 provided on the main board 113. The sub-guide pin 114 facing the guide pin 110 and facing the Hall IC 115 is provided at the electrical holder 112.

With this structure, the main board 113 and the Hall IC 115 are covered with the electrical holder 112, and a dustproof state is kept even if the explosion-proof container 101 is open. Also, since the gap d is provided between the guide pin 110 and the sub-guide pin 114, while the magnetic flux passes through the guide pin 110 and then the sub-guide pin 114, even if an external force is applied to the explosion-proof container 101 and hence the main cover 104 is bent inward, the guide pin 110 and the sub-guide pin 114 are prevented from contacting each other and are protected from the external force. Also, a phenomenon, in which the influence of the heat from the outside of the explosion-proof container 101 is given to the guide pin 110, then the sub-guide pin 114, and the Hall IC 115, can be prevented from occurring. The electrical holder 112 covers the space above the Hall IC 115 provided on the main board 113. However, the electrical holder 112 may not cover the entire surface of the main board 113 provided with the Hall IC 115, and the electrical holder 112 may cover a partial surface including the area provided with the Hall IC 115.

In this positioner 100, if the cover 102 is removed, the main cover 104 is exposed, and the push button 106 mounted at the switch holder 105 is pushed, the push button 106 is moved toward the bottom portion of the mounting hole 108 of the switch holder 105 against the urging force of the compression coil spring 109. Hence, the magnet 107 provided at the bottom portion of the push button 106 is moved close to the end surface 110*a* of the guide pin 110 provided at the main cover 104, and the magnetic field from the magnet 107 acts on the Hall IC 115 in the explosion-proof container 101 through the guide pin 110 provided at the main cover 104 and further through the sub-guide pin 114. Accordingly, the Hall IC 115 is turned ON. The state of the push button 106-2 shown in FIG. 5 indicates this state.

If the push bottom 106 is no longer pushed, the push button 106 is returned to the original position by the urging force of the compression coil spring 109. Hence, the magnet 107 provided at the bottom portion of the push button 106 is moved far from the end surface 110*a* of the guide pin 110 provided at the main cover 104, and the Hall IC 115 no longer senses the magnetism from the magnet 107. Accordingly, the Hall IC 115 is turned OFF. The state of the push button 106-1 shown in FIG. 5 indicates this state.

In this embodiment, the push button 106, the magnet 107, the compression coil spring 109, the guide pin 110, the sub-guide pin 114, and the Hall IC 115 configure a magnetic switch SW. A distance L between adjacent magnetic switches SW is 20 mm, a distance H between a lower surface of the magnet 107 and an upper surface of the Hall IC 115 when the push button 106 is pushed is 30 mm, and a gap d between the guide pin 110 and the sub-guide pin 114 is about 1 to 2 mm.

Also, in this embodiment, the end surface 110*a* of the guide pin 110 is located in the recess portion 111 formed at the bottom surface of the mounting hole 108 of the switch holder 105; however, the end surface 110*a* of the guide pin 110 may be embedded in the middle of the main cover 104 without being exposed from the main cover (container wall) 104. Also, the end surface 110*b* of the guide pin 110 may be embedded in the middle of the main cover 104 without being exposed from the main cover (container wall) 104.

Also, in this embodiment, the first end surface 114*a* and the second end surface 114*b* of the sub-guide pin 114 provided at the electrical holder 112 are exposed from the electrical holder 112; however, the end surface 114*a* or 114*b* of the sub-guide pin 114 may not be exposed from the electrical holder 112. That is, both or one of the end surfaces 114*a* and 114*b* of the sub-guide pin 114 may be embedded in the middle of the electrical holder 112 without being exposed from the electrical holder 112.

Also, in this embodiment, the end surface 114*b* of the sub-guide pin 114 may be brought into contact with the Hall IC 115 provided on the main board 113. Alternatively, the end surface 114*b* may have a gap with respect to the Hall IC 115 without contacting the Hall IC 115.

Also, in this embodiment, the example is described in which the explosion-proof device is applied to the positioner and the switch structure according to the disclosure is applied to this positioner. However, an explosion-proof device, such as a pressure transmitter or an electromagnetic flowmeter, may use the switch structure according to the disclosure.

Also, the magnetic body 4 according to the first embodiment and the guide pin 110 and the sub-guide pin 114 according to the second embodiment are desirably formed of a ferromagnetic body such as a permalloy. Also, in the second embodiment, the guide pin 110 and the sub-guide pin 114 may be formed of the same material, and may be formed of different materials.

Extension of Embodiments

The disclosure has been described above with reference to the embodiments; however, the disclosure is not limited to the above-described embodiments. The configurations and specifications of the disclosure can be modified in various ways understandable by those skilled in the art within the technical idea of the disclosure.

INDUSTRIAL APPLICABILITY

The disclosure can be used for various devices each turning ON/OFF a magnetic sensor in a hermetically sealed container, such as a positioner that controls the opening degree of a pneumatically operated control valve.

REFERENCE SIGNS LIST

1 explosion-proof container
1*a* container wall
(2-1 to 2-4) magnetic sensor
(3-1 to 3-4) magnet
(4-1 to 4-4) magnetic body
4*a* first end surface
4*b* second end surface
SW (SW1 to SW4) magnetic switch
100 positioner
101 case (explosion-proof container)
102, 103 cover
104 main cover
105 switch holder
106 (106-1 to 106-4) push button
107 magnet
108 mounting hole
109 compression coil spring
110 guide pin
110*a* first end surface
110*b* second end surface
111 recess portion
112 electrical holder
113 main board
114 sub-guide pin
114*a* first end surface
114*b* second end surface
115 Hall IC

The invention claimed is:

1. A switch, comprising:
a hermetically sealed container including a container wall separating an inside of the hermetically sealed container from an outside of the hermetically sealed container;
a magnetic sensor arranged in the hermetically sealed container and configured to be turned ON/OFF by a magnetic field of a magnet acting from the outside of the hermetically sealed container through the container wall of the hermetically sealed container;
a first magnetic body provided at the container wall of the hermetically sealed container; and
a second magnetic body facing the first magnetic body and the magnetic sensor, wherein
the first magnetic body and the second magnetic body serves as a path of the magnetic field acting on the magnetic sensor from the magnet.

2. The switch according to claim 1, further comprising:
a mounting hole on which the magnet is mounted such that the magnet is provided on the mounting hole movably back and forth with respect to an end surface of the first magnetic body, the end surface being exposed to the outside of the hermetically sealed container.

3. The switch according to claim 2, further comprising:
a switch holder formed of a non-magnetic body and holding the magnet movably back and forth, wherein
the switch holder is mounted on the outside of the hermetically sealed container, and
the end surface of the first magnetic body, which is exposed to the outside of the hermetically sealed container, penetrates through the container wall of the hermetically sealed container and is located in a recess portion formed at a bottom surface of the switch holder.

4. The switch according to claim 1, further comprising:
a plurality of the magnetic sensors arranged adjacent to each other in the hermetically sealed container, and
a plurality of the first magnetic bodies, each of the plurality of first magnetic bodies being provided at the container wall of the hermetically sealed container for each of the magnetic sensors.

5. The switch according to claim 1, wherein the hermetically sealed container is an explosion-proof container.

6. The switch according to claim 1, wherein the container wall is formed of a material having lower magnetism than the first magnetic body.

7. The switch according to claim 6, wherein the container wall is formed of a non-magnetic material.

8. The switch according to claim 6, further comprising:
the magnet generating the magnetic field.

9. The switch according to claim 1, wherein the first magnetic body has a columnar shape.

10. The switch according to claim 1, wherein a first end surface of the first magnetic body is exposed to the outside of the hermetically sealed container.

11. The switch according to claim 1, wherein a second end surface of the first magnetic body is exposed to the inside of the hermetically sealed container.

12. The switch according to claim 1, wherein
a relative position of the first magnetic body, the second magnetic body, and the magnetic sensor are fixed,
the magnet is configured to move toward the first magnetic body, and
the magnetic sensor is configured to be turned ON by moving the magnet toward the first magnetic body.

13. The switch according to claim 12, wherein the magnetic sensor is configured to be turned ON by moving the magnet toward the first magnetic body.

14. The switch according to claim 12, further comprising:
a push button holding the magnet, the push button being configure to move the magnet toward the first magnetic body; and
a substrate to fix the relative position of the first magnetic body, the second magnetic body, and the magnetic sensor.

15. The switch according to claim 1, wherein the magnet, the first magnetic body, the second magnetic body, and the magnetic sensor are arranged on a straight line.

16. The switch according to claim 15, wherein the magnet, the first magnetic body, the second magnetic body, and the magnetic sensor are arranged on the straight line in this order.

17. The switch according to claim 15, wherein
the magnet is configured to move toward the first magnetic body along the straight line, and
the magnetic sensor is configured to be turned ON by moving the magnet toward the first magnetic body along the straight line.

18. The switch according to claim 1, wherein a gap is provided between the first magnetic body and the second magnetic body.

19. The switch according to claim 1, further comprising:
a substrate provided with the magnetic sensor; and a substrate holding member provided in the hermetically sealed container to hold the substrate to cause a surface of the substrate provided with the magnetic sensor to face the container wall of the hermetically sealed container, and to cover a space above the magnetic sensor provided on the substrate, wherein the second magnetic body is provided at the substrate holding member.

20. A switch, comprising:

a hermetically sealed container including a container wall separating an inside of the hermetically sealed container from an outside of the hermetically sealed container;

a magnetic sensor arranged in the hermetically sealed container and configured to be turned ON/OFF by a magnetic field of a magnet acting from the outside of the hermetically sealed container through the container wall of the hermetically sealed container;

a first magnetic body provided at the container wall of the hermetically sealed container and serving as a path of the magnetic field acting on the magnetic sensor from the magnet;

a substrate provided with the magnetic sensor;

a substrate holding member provided in the hermetically sealed container to hold the substrate to cause a surface of the substrate provided with the magnetic sensor to face the container wall of the hermetically sealed container, and to cover a space above the magnetic sensor provided on the substrate; and a second magnetic body provided at the substrate holding member and facing the first magnetic body and the magnetic sensor, wherein a gap is provided between the first magnetic body and the second magnetic body.

21. The switch according to claim 20, wherein the first magnetic body and the second magnetic body serve as the path of the magnetic field acting on the magnetic sensor from the magnet.

22. The switch according to claim 20, wherein the first magnetic body and the second magnetic body are formed of a ferromagnetic material.

23. A sealed electronic device comprising:

a switch including a hermetically sealed container including a container wall separating an inside of the hermetically sealed container from an outside of the hermetically sealed container;

a magnetic sensor arranged in the hermetically sealed container and configured to be turned ON/OFF by a magnetic field of a magnet acting from the outside of the hermetically sealed container through the container wall of the hermetically sealed container;

a first magnetic body provided at the container wall of the hermetically sealed container; and a second magnetic body facing the first magnetic body and the magnetic sensor; and an electronic device configured to be controlled by the magnetic sensor, the electronic device being electrically connected to the magnetic sensor and provided inside the hermetically sealed container, wherein the first magnetic body and the second magnetic body serves as a path of the magnetic field acting on the magnetic sensor from the magnet.

* * * * *